United States Patent [19]

Kern

[11] Patent Number: 4,682,133

[45] Date of Patent: Jul. 21, 1987

[54] ELECTRO-MAGNETIC RELAY HAVING TWO ARMATURES

[75] Inventor: Josef Kern, Berlin, Fed. Rep. of Germany

[73] Assignee: Siemens Aktiengesellschaft, Berlin and Munich, Fed. Rep. of Germany

[21] Appl. No.: 894,827

[22] Filed: Aug. 8, 1986

[30] Foreign Application Priority Data

Aug. 14, 1985 [DE] Fed. Rep. of Germany ..... 3529158

[51] Int. Cl.[4] ..... H01H 67/02

[52] U.S. Cl. ..... 335/119; 335/128; 335/265

[58] Field of Search ..... 335/119, 121, 124, 128, 335/261, 265, 276

[56] References Cited

U.S. PATENT DOCUMENTS

| | | | |
|---|---|---|---|
| 1,383,494 | 7/1921 | Soreng | 335/265 X |
| 1,581,830 | 4/1926 | Beschnitt | 335/265 X |
| 1,795,787 | 3/1931 | Mattingly | 335/265 |
| 2,353,377 | 7/1944 | Vaughn | 335/265 X |
| 3,801,940 | 4/1974 | Grassl | 335/135 |

FOREIGN PATENT DOCUMENTS

| | | | |
|---|---|---|---|
| 612428 | 10/1926 | France | 335/119 |
| 783822 | 7/1935 | France | 335/119 |
| 2204870 | 5/1974 | France | 335/119 |
| 621770 | 4/1949 | United Kingdom | 335/119 |

*Primary Examiner*—George Harris

*Attorney, Agent, or Firm*—Hill, Van Santen, Steadman & Simpson

[57] ABSTRACT

A relay includes two armatures each having a contact spring and a contact piece secured thereto which interacts with the respective cooperating contact element. The two movable contact pieces are electrically connected by a stranded copper conductor so that a series connection of the two contacts is formed. The series connection can be interrupted twice by the two armatures which switch independently of one another so that a reliable opening of the circuit is assured even if one of the contacts fuses. The relay is particularly useful for safety circuits such as in motor vehicles.

9 Claims, 8 Drawing Figures

ELECTRO-MAGNETIC RELAY HAVING TWO ARMATURES

BACKGROUND OF THE INVENTION

1. Field of the Invention

The present invention relates generally to an electromagnetic relay, and more specifically to a relay having two flat armatures each disposed at one end of a coil and each seated at a yoke end.

2. Description of the Prior Art

A relay is disclosed in French Pat. No. 2,204,870 having first and second armatures wherein the resulting double working air gap is used to independently actuate separate switch-over contacts with each armature.

A middle contact piece is secured on the rigid armature, whereas the cooperating contact elements are anchored in a pedestal. The two armatures and their respective contact pieces are insulated from one another by an insulating intermediate ply so that two circuits are formed independently of one another.

A coincidence of the armature stroke occurs due to the direct connection of the contact piece and the armature, which can lead to intensified chatter and to misadjustment. There is also a risk, particularly due to contact burning, that the contact will not adequately close and will tend to fuse. These disadvantages are partially eliminated in that two core parts having an intervening spring are biased against the two armatures in one embodiment thereof. However, in such case, an additional insulating foil must be provided which likewise electrically insulates the armatures which have disconnected, insulating them from the core parts and from one another, whereby, in any case, the magnetic circuit is deteriorated.

In addition, there is a general problem of fusing of contacts in relays. This problem occurs with particular frequency when relatively high powers are to be output with relatively low voltages such as from a battery so that high currents flow through the contacts, for example, as in the case of motor vehicles. It is precisely in this area of employment that there is a high safety risk when a relay contact fuses in a safety device and can no longer be opened, such as, for example, in an anti-blocking system so that a high current which actually was intended to flow for only a short period of time flows continuously. This causes impermissible heating of the winding and other parts and, over and above that, can cause further damage.

SUMMARY OF THE PRESENT INVENTION

An object of the present invention is to considerably alleviate fusing tendencies in a relay for use in safety circuits. Another of the present invention is to assure that a circuit may still be reliably opened after fusing of a contact. These and other objects are provided in a two armature relay according to the present invention wherein two movable contact pieces are mounted on corresponding contact springs secured to respective armatures and are connected to one another by an electrical conductor element. The two armatures are respectively seated on a bearing blade of the yoke and extend beyond the bearing blade at a continuation portion, the continuations of both armatures being connected to one another behind the bearing plate by a common restoring spring stressed for tension.

Due to the contact springs provided at each armature in accordance with the invention, in contrast with the known two armature relays, both armatures, despite tolerance variations which may occur, lie fully against the core pole face and both contacts are also closed with sufficient contacting force in every instance. An excess stroke which can be set assures that even after the contacts have been burned off to a certain degree an adequate contacting force is still achieved, so that the tendency of the contact pieces to fuse is reduced as a result thereof.

Both armatures have the same restoring force due to the shared spring. If one of the two armatures were to no longer open due to fusing of its contact, then the other armature would receive an even greater restoring force due to the tensed restoring spring and is, therefore, all the more certain to open.

What is more important over and above this in the present invention, however, is the provision of an electrical connection between the two movable contact pieces that are actuatable independently of one another by the two armatures. The two contacts can, thus, be switched into the load circuit in series, considerably improving reliability since it is usually at most one of the two series contacts which will fuse.

The use of two electrically connected contacts in a two armature relay, however, is especially useful because the magnetic properties of the two armature relay are additionally exploited here. Because the two working air gaps are simultaneously reduced by the attraction of the two armatures from the quiescent condition, the force of attraction is disproportionately increased in comparison to the attraction of a single armature. The switching speed at the moment when both contacts are closed is especially high so that the tendency of the contacts to fuse is further reduced. This is important particularly for applications in motor vehicles or in similar battery-supplied systems.

For contacts connected in series, load current does not flow until both armatures are close to the pole face so that the two air gaps have become extremely small. When this condition is reached, the two armatures are then completely attracted to the pole face even if the battery voltage were to collapse due to the closing of the contacts and due to the flow of a high load current. This also contributes to the fact that a floating condition is avoided during closing of the contacts. A floating condition usually leads to the fusing of the contacts in most cases.

Since the relay winding is designed so that the necessary attraction, or flux, required is generated for two armatures which have opened, a very favorable ratio of response voltage and lugging voltage derives for the present relay. Thus, a very fast attraction of the armature is enabled in the last portions of the attraction motion upon exertion of high contacting forces.

The described advantages of the present relay become effective particularly when both contacts of the relay are fashioned as make-contacts. Since, in such case, the closing of the contacts is accompanied by the attraction of the two armatures, the greatest magnetic forces are converted into correspondingly high contacting forces.

In some cases, however, the two contacts of the relays can be formed as break-contacts which open independently of one another should contact fusing occur. In such case, the appertaining armature of the fused contact remains in an open position so that the magnetic circuit is no longer completely closed. For an appropriately designed relay, however, the second armature will still attract and interrupt the series circuit through the second break contact.

In a further modification of the present device, it is provided that the stranded copper conductor connected between the two make- or break-contacts have its own additional terminal elements. It would be possible to undertake a parallel connection of the two contacts instead of a series connection, so that a double make-contact or a double break-contact is formed. However, in this case, it is no longer guaranteed that a parallel circuit would be interrupted once a contact has fused, although in certain instances, such an application may be useful.

For an embodiment in the form of a double make-contact or a double break-contact, it is possible to set the two contact gaps differently from one another so that the two contacts operate successively. A contact material which has only a slight tendency to fuse can then be used at the contact which closes earlier or which opens later and at which fusing could occur.

In contrast to the known relay, the subject relay cannot be meaningfully operated with switch-over contacts since fusing of one contact would cause a bridging between the two switched circuits over the electrical connection of the two movable contact elements. However, it is conceivable to apply a cooperating contact in the manner of switch-over contacts to the respective switch position of the armature or of the movable contact piece which is not used. The additional cooperating contact elements are not used then for switching a second circuit but only as a monitor. One example of how such a monitor could be used is to identify through a logic circuit when one of the contacts has fused. Although the function of the circuit is not disturbed since the second armature still interrupts the circuit, such a monitoring circuit could be used to display information as to the replacement of the relay in time before the second one of the contacts fuses.

The electrical conductor element of the present relay is expediently a stranded conductor of copper, or some other material exhibiting similarly good conductivity, which is welded directly to the two contact pieces. A high load current can, thus, be transmitted between the two contacts without risk of excessive heating. The contact spring at the respective armature which generates the contacting pressure can then be formed of optimum spring material, such as spring steel, which need not exhibit good electrical conductivity.

The coil serves as a carrier for the functional elements of the subject relay. Thus, two coil body flanges have respective recesses for plug fastening of a yoke and also include further recesses for holding the stranded copper conductor. At the side of the coil flanges lying opposite the yoke, recesses are preferably included for plug fastening of cooperating contact elements.

DESCRIPTION OF THE PREFERRED EMBODIMENTS

Figure 1:
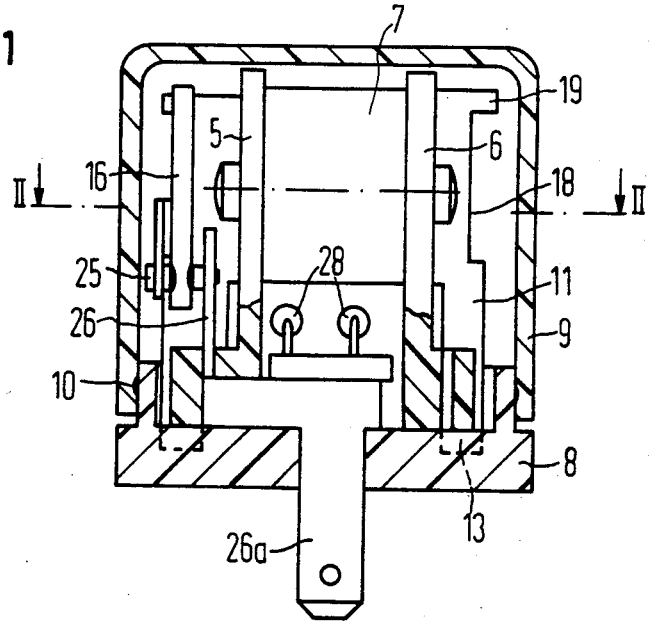
FIG. 1 is a vertical cross-section of a relay according to the principles of the present invention in which make-contacts are provided opening independently of one another.
Figure 2:
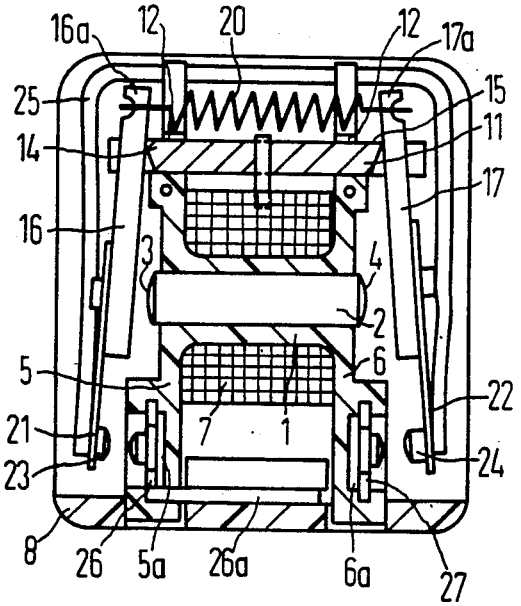
FIG. 2 is a cross-section of the device shown in FIG. 1 along lines II—II showing additional details thereof.

In FIG. 1, and also with reference to FIG. 2, a relay is shown having a coil body 1 including a core 2 impressed into an axial, through-extending bore, the core 2 having two pole faces 3 and 4 at the respective opposing ends. The coil body 1 has two flanges 5 and 6 between which a winding 7 is applied. The coil body 1, core 2 and winding 7 have an axis arranged parallel to a mounting plane on a flat pedestal 8, which forms a housing together with a cap 9. An overlap 10 between the pedestal 8 and the cap 9 of the housing parts is secured, such as being welded by ultrasound.

The magnetic circuit of the present relay includes a flat flux plate on yoke 11 that is provided essentially perpendicular to the mounting plane next to the coil and is secured by plugging in recesses 12 of the coil body flanges 5 and 6. Continuations 13 of the yoke 11 are shown in FIG. 1 and are anchored in the pedestal 8. The yoke or flux plate 11 includes bearing blades 14 and 15 at each respective end at which armatures 16 and 17 are seated, respectively. To secure the armatures 16 and 17 against cross dislocation on the bearing blades 14 and 15, the yoke 11 is provided with incisions 18, or with projections 19 in which the armatures 16 and 17 are disposed.

In the region behind the bearing blades 14 and 15, each armature 16 and 17 includes a continuation **16*a* or 17*a* which engages a common restoring spring 20. The restoring spring 20 is stressed for tension and pulls the two armatures 16 and 17** into their quiescent positions, i.e. into their open position, with identical restoring force.

A contact spring includes a contact piece 23 and is secured to the armature 16, while a contact spring 22 includes a contact piece 24 and is secured to the armature 17. The two contact pieces 23 and 24 are connected to one another by a stranded copper conductor 25 which extends around the two armatures 16 and 17 at the outside thereof and has its ends connected to the respective contact pieces 23 and 24 through a recess in the respective contact springs 21 and 22. Current which is switched by the present relay and which may be a high current under certain conditions is not conducted through the contact springs which are preferably of spring steel nor through the armatures, but is carried by the stranded conductor 25.

Opposite the two movable contact pieces 23 and 24, two stationary cooperating contact elements 26 and 27 are anchored in recesses **5*a* and 6*a* of the respective coil body flanges 5 and 6. The contact elements 26 and 27 include terminal pins or plugs, such as the terminal pin 26*a* which is conducted through the pedestal 8. Space for additional components 28** which may be, for example, diodes or resistors, is also provided under the winding 7 on the pedestal.

The relay operates as follows: when the coil is excited through the winding 7, both armatures 16 and 17 are attracted toward the core 2. The contact pairs 23 and 26, and 24 and 27, close. A series circuit between the two cooperating contact elements 26 and 27 is formed by the stranded conductor 25. When the coil excitation is discontinued, both armatures 16 and 17 open so that the circuit is interrupted twice. If one of the two contacts 23 and 26, or 24 and 27 were to fuse, then the other contact would still open.

Figure 3:
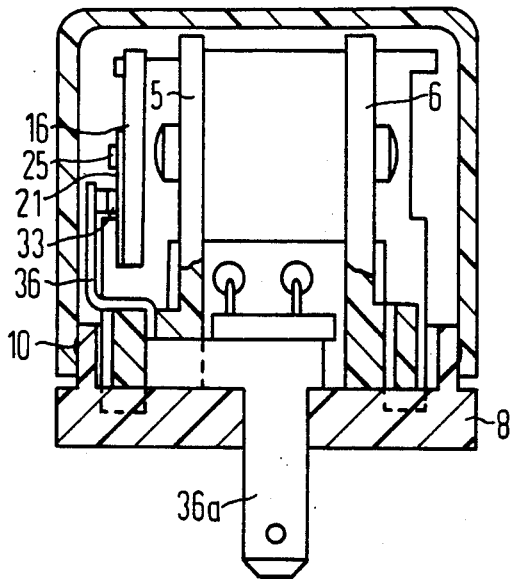
FIG. 3 is a vertical cross-section of the inventive relay including break-contacts switchable independently of one another.
Figure 4:
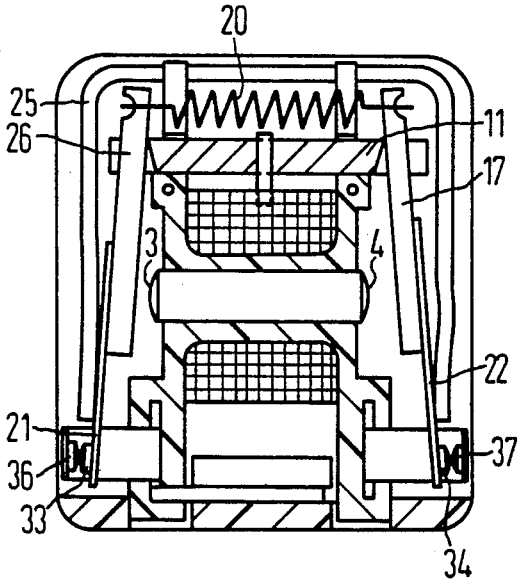
FIG. 4 is a horizontal cross-section through the device of FIG. 3 showing additional details thereof.

With reference to FIGS. 3 and 4, a slightly modified form of the present relay is shown in which parts identical to those shown in FIGS. 1 and 2 are provided with the same reference characters. The two contact springs 21 and 22 have outwardly directed contact pieces 33 and 34 which interact with cooperating contact elements 36 and 37. The contact elements, thus, form break-contacts and the relay forms a series circuit with two break-contacts in the quiescent condition through the two armatures 16 and 17. The armatures 16 and 17 interrupt the circuit twice independently of one another when the relay is excited. Even should one of the break-contacts fuse, the second armature is still moved and interrupts the circuit, although an optimally closed magnetic circuit is no longer present.

In FIGS. 1 and 3, the armature 17 and contact elements 22, 24, 27 and 37 have been omitted for the sake of clarity.

Figure 6:
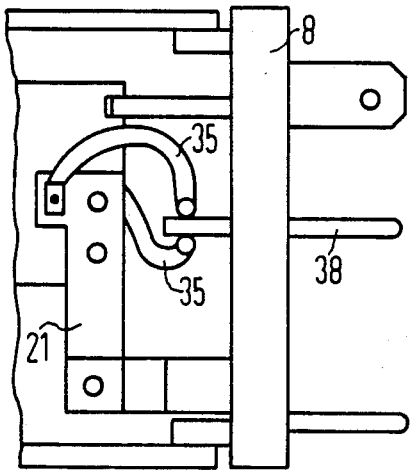
FIG. 6 is a partial vertical cross-section of the relay shown in FIG. 5.
Figure 5:
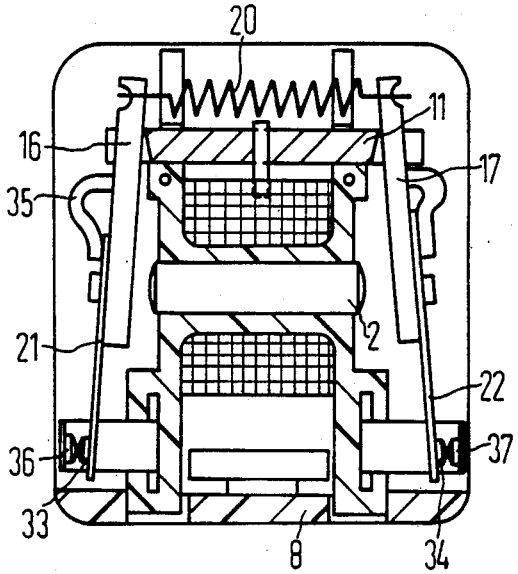
FIG. 5 is a horizontal cross-section of a further embodiment of the present relay having contacts wired as double break-contacts.
Figure 8:
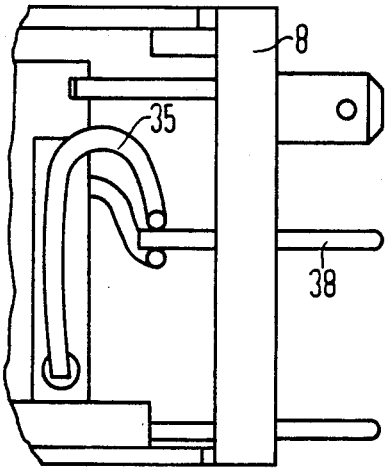
FIG. 8.is a partial vertical cross-section of the relay shown in FIG. 7.

A further modification of the present invention is shown in FIGS. 5 and 6 in which the two contact springs 21 and 22 are connected by a stranded conductor 35 which is also connected to an additional plug connection 38. The two break-contact pieces 33 and 34, thus, comprise an additional common terminal and can also be switched parallel as a double break-contact. The illustrated relay functions in the same way as the above-described relays. It also suppresses fusing to the greatest possible degree. The two contacts are set with different contact spacing and are equipped with different contact materials so that the contact with fusing resistant material opens last or closes first and, thus, draws any arcs which may potentially arise. The other contact has a material of high conductivity and carries the majority of the load current during operation, but is not exposed to any arc.

Figure 7:
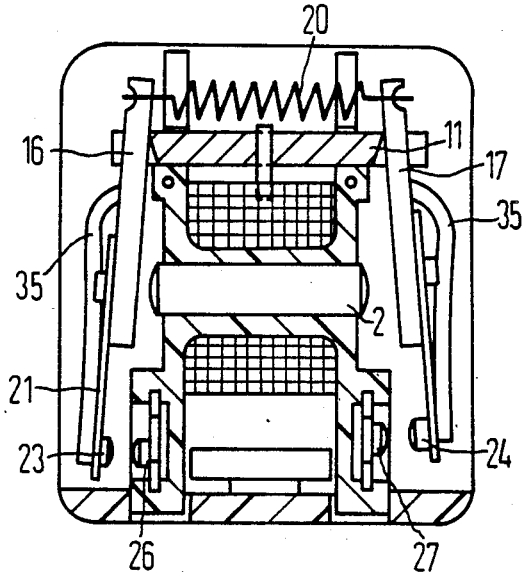
FIG. 7 is a horizontal cross-section of a further embodiment of the relay of the present invention including double make-contacts.

In FIGS. 6 and 7, a similar modification is shown for make-contacts. The stranded conductor 35 is extended from the contact pieces 23 and 24 to the additional connection 38. The illustrated relay can be used as a double make-contact relay, whereby the two make contacts are connected in parallel, but are actuated by the two armatures which lie in series magnetically. As in the previous case, a high degree of protection is achieved with different contact spacings and with the use of fusing resistant contact material for the contact that closes first and/or which opens last.

Although modifications and changes may be suggested by those skilled in the art, it is the intention of the inventor to embody within the patent warranted hereon all changes and modifications as reasonably and properly come within the scope of his contribution to the art.

I claim as my invention:

1. An electro-magnetic relay, comprising:

a coil having a coil body defining a mounting plane and an axially extending core extending parallel to the mounting plane and a winding around said core;

a yoke disposed adjacent said coil and parallel to said axis and having a bearing blade at each of first and second opposite ends;

first and second flat armatures extending substantially perpendicular to said axis at respective opposite ends of said coil, each of said flat armatures being seated on one of said bearing blades at one of said opposing yoke ends and forming a working air gap with an end of said core, each of said first and second flat armatures having a continuation extending beyond said bearing blade;

a common restoring spring stressed for tension connecting said continuations of said first and second armatures behind said bearing blades;

a contact spring carried by each of said first and second armatures;

movable contact elements on said contact springs;

an electrical conductor element connecting said movable contact elements on said two contact springs; and cooperating contact elements for interaction with said movable contact elements, whereby said first and second armatures are independently openable to form a two contact series connection relay.

2. An electro-magnetic relay as claimed in claim 1, wherein said electrical conductor element is a stranded conductor of good conductivity and is welded to said two movable contact elements.

3. An electro-magnetic relay as claimed in claim 2, wherein said stranded conductor is of copper.

4. An electro-magnetic relay as claimed in claim 1, wherein said coil body includes flanges having recesses into which said yoke is plug-in fastened.

5. An electro-magnetic relay as claimed in claim 1, wherein said coil body includes flanges having recesses lying opposite said yoke for plug-in fastening of said cooperating contact elements.

6. An electro-magnetic relay as claimed in claim 1, wherein said movable contact elements and said cooperating contact elements form make-contacts.

7. An electro-magnetic relay as claimed in claim 1, wherein said movable contact elements and said cooperating contact elements form break-contacts.

8. An electro-magnetic relay as claimed in claim 1, further comprising: a terminal element for said electrical conductor element connecting said movable contact elements.

9. An electro-magnetic relay as claimed in claim 8, wherein said movable contact elements and said cooperating contact elements form two successively operating contacts, and wherein one contact pair of said movable contact elements and said cooperating contact elements is formed of contact pieces having a low tendency to fuse and said one contact pair operating at least one of closing earlier and opening later relative to said other contact.

* * * * *